US010145212B2

(12) United States Patent
Lastra et al.

(10) Patent No.: US 10,145,212 B2
(45) **Date of Patent: *Dec. 4, 2018**

(54) HYDRAULICALLY ASSISTED DEPLOYED ESP SYSTEM

(71) Applicant: Saudi Arabian Oil Company, Dhahran (SA)

(72) Inventors: Rafael Adolfo Lastra, Dhahran (SA); Abubaker Saeed, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 15/863,388

(22) Filed: Jan. 5, 2018

(65) Prior Publication Data

US 2018/0128083 A1 May 10, 2018

Related U.S. Application Data

(63) Continuation-in-part of application No. 14/980,748, filed on Dec. 28, 2015, now Pat. No. 9,976,392.
(Continued)

(51) Int. Cl.
*E21B 41/00* (2006.01)
*E21B 43/12* (2006.01)
(Continued)

(52) U.S. Cl.
CPC ..... *E21B 41/00* (2013.01); *E21B 23/01* (2013.01); *E21B 43/128* (2013.01); *E21B 2023/008* (2013.01)

(58) Field of Classification Search
CPC .... E21B 2023/008; E21B 23/01; E21B 41/00; E21B 43/128
See application file for complete search history.

(56) References Cited

U.S. PATENT DOCUMENTS 4,391,330 A 7/1983 Kiefer
6,454,011 B1 9/2002 Schempf et al.
(Continued)

FOREIGN PATENT DOCUMENTS

WO 0102699 A1 1/2001

OTHER PUBLICATIONS

International Search Report and Written Opinion for related PCT application PCT/US2015/068257 dated Mar. 31, 2016.

*Primary Examiner* — James G Sayre
(74) *Attorney, Agent, or Firm* — Bracewell LLP; Constance G. Rhebergen; Linda L. Morgan

(57) ABSTRACT

A system and method for providing artificial lift to production fluids within a subterranean well includes loading an electrical submersible pump assembly into an interior cavity of a pump launcher. The electrical submersible pump assembly has a motor and a pump. The pump launcher is releasably secured to a wellhead so that the interior cavity is in fluid communication with an inner bore of a production tubing that extends a length into the subterranean well. A propulsion system is activated to move the electrical submersible pump assembly from the pump launcher and into the subterranean well, wherein the propulsion system includes a self-powered robotic system having a propulsion mechanism. The propulsion system can be communicated with to control the descent of the electrical submersible pump assembly through the subterranean well.

18 Claims, 6 Drawing Sheets

Related U.S. Application Data

(60) Provisional application No. 62/099,253, filed on Jan. 2, 2015.

(51) Int. Cl.
*E21B 23/01* (2006.01)
*E21B 23/00* (2006.01)

(56) References Cited

U.S. PATENT DOCUMENTS

| | | | | |
|---|---|---|---|---|
| 7,748,449 | B2 | 7/2010 | Bussear et al. | |
| 8,381,820 | B2 | 2/2013 | Martinez | |
| 8,844,636 | B2 | 9/2014 | Bebak et al. | |
| 9,080,412 | B2 | 7/2015 | Wetzel et al. | |
| 9,976,392 | B2 * | 5/2018 | Lastra | E21B 41/00 |
| 2001/0050173 | A1 | 12/2001 | Head | |
| 2004/0188096 | A1 | 9/2004 | Traylor | |
| 2008/0128128 | A1 * | 6/2008 | Vail | E21B 4/18 166/250.15 |
| 2010/0116506 | A1 | 5/2010 | Sbordone et al. | |
| 2013/0180730 | A1 | 7/2013 | Bebak et al. | |
| 2013/0222148 | A1 | 8/2013 | Gano et al. | |
| 2015/0136424 | A1 | 5/2015 | Hughes et al. | |

* cited by examiner

HYDRAULICALLY ASSISTED DEPLOYED ESP SYSTEM

CROSS REFERENCE TO RELATED APPLICATIONS

This application is a continuation in part of co-pending U.S. application Ser. No. 14/980,748 titled "Hydraulically Assisted Deployed ESP System," filed Dec. 28, 2015, which claims priority to and the benefit of U.S. Provisional Application No. 62/099,253, titled "Hydraulically Assisted Deployed ESP System," filed Jan. 2, 2015, the full disclosure of each which is hereby incorporated by reference herein in its entirety.

BACKGROUND OF THE DISCLOSURE

1. Field of the Disclosure

The present disclosure relates generally to improving production from subterranean wells with artificial lift, and in particular systems and methods for deploying electric submersible pumps.

2. Description of the Related Art

In hydrocarbon developments, it is common practice to use electric submersible pumps (ESPs) as a primary form of artificial lift. Artificial lift in oil and gas production uses ESPs in the wellbore to lift fluids from downhole to surface and push them to processing facilities. The ESPs of some current systems can be conveyed with the production tubing or coiled tubing. However, tubing installed systems require workover rigs for installing, removing, and changing out the ESPs. In addition, changing pump setting depth requires workover rigs to pull out the tubing and re-install the landing profile at a different depth. An ESPs' run life is relatively short. When the equipment fails, a workover rig is required to pull out the failed equipment and install a new system. Changing pump depth is not uncommon. Often, as reservoir pressure, water cut or productivity changes, it is necessary to install the pump system at a different depth in order to optimize system performances. Workover rigs are expensive and the waiting time for rigs can be long.

SUMMARY OF THE DISCLOSURE

Embodiments of the present disclosure provide systems and methods for installing ESPs, and performing frequent ESP change outs without the need for high cost rigs. Embodiments of this disclosure can deploy and retrieve ESPs using hydraulic power and eliminating the need of some conventional high cost ESP deployments that require using a rig or coiled tubing deployment systems. The system is self-contained and does not require the use of conventional lubricators, minimizes the surface equipment footprint, and reduces the time needed to deploy and retrieve ESPs compared to some current ESP installation systems.

In an embodiment of this disclosure, a method for providing artificial lift to production fluids within a subterranean well includes loading an electrical submersible pump assembly into an interior cavity of a pump launcher. The electrical submersible pump assembly has a motor and a pump. The pump launcher is releasably secured to a wellhead so that the interior cavity is in fluid communication with an inner bore of a production tubing that extends a length into the subterranean well. A propulsion system is activated to move the electrical submersible pump assembly from the pump launcher and into the subterranean well, wherein the propulsion system includes a self-powered robotic system having a propulsion mechanism. By communicating with the propulsion system, the descent of the electrical submersible pump assembly through the subterranean well is controlled.

In alternate embodiments, the electrical submersible pump assembly can be moved through the subterranean well with the propulsion system until the electrical submersible pump assembly reaches a set packer. The electrical submersible pump assembly can be latched to the set packer. The electrical submersible pump assembly can be unlatched from the set packer and returned to the pump launcher with the propulsion system. The speed of the electrical submersible pump assembly can be monitored with a guide wire, the guide wire being a non-load bearing cable that extends from the electrical submersible pump assembly to the pump launcher. A condition of the subterranean well can be sensed with the piston device.

In other alternate embodiments, the propulsion system can further include a piston device, the piston device having an outer diameter profile, and communicating with the propulsion system to control the descent of the electrical submersible pump assembly through the subterranean well can include communicating with the piston device. The step of communicating with the piston device to control the descent of the electrical submersible pump assembly through the subterranean well can include changing the outer diameter profile of the piston device to change a vector sum of forces applied on the pressure surfaces of the piston device.

In yet other alternate embodiments, activating the propulsion system can include remotely controlling the self-powered robotic system. The propulsion mechanism can include a propeller and a driver to rotate the propeller, and the method can further include controlling a speed and direction of movement of the electrical submersible pump assembly through the subterranean well by remotely controlling the driver.

In still other alternate embodiments, the propulsion mechanism of the self-powered robotic system can include a thrust assembly, the thrust assembly having thrust gates moveable between a gates open position and a gates closed position. The self-powered robotic system can further include an impeller directing the production fluids towards the thrust gates. The thrust gates can be moved between the gates open position and the gates closed position to control the speed and direction of the electrical submersible pump assembly within the inner bore of the production tubing.

In an alternate embodiment of the current disclosure, a method for providing artificial lift to production fluids within a subterranean well includes loading an electrical submersible pump assembly into an interior cavity of a pump launcher. The electrical submersible pump assembly has a motor and a pump and a self-powered robotic system including a thrust assembly, the thrust assembly having thrust gates moveable between a gates open position and a gates closed position. The pump launcher is releasably secured to a wellhead so that the interior cavity is in fluid communication with an inner bore of a production tubing that extends a length into the subterranean well. The method further includes communicating with the self-powered robotic system to move the electrical submersible pump assembly from the pump launcher and into the subterranean well and communicating with the self-powered robotic system to control the descent of the electrical submersible pump assembly through the subterranean well.

In alternate embodiments, the method can further comprise moving the thrust gates between the gates open position and the gates closed position to control the speed and direction of the electrical submersible pump assembly within the inner bore of the production tubing. The production fluid can be directed through a body of the self-powered robotic system and towards the thrust gates with an impeller.

In yet another alternate embody of this disclosure, an electric submersible pump system for providing artificial lift to production fluids within a subterranean well includes a pump launcher releasably secured to a wellhead. The pump launcher has an interior cavity in fluid communication with an inner bore of a production tubing that extends a length into the subterranean well. The electric submersible pump system includes an electrical submersible pump assembly having a motor and a pump. A propulsion system is associated with the piston device, selectively moving the electrical submersible pump assembly through the production tubing, the propulsion system including a self-powered robotic system having a propulsion mechanism.

In alternate embodiments, the propulsion system can include a piston device, the piston device having an outer diameter profile. The piston device can have a top pressure surface acted on to move the electrical submersible pump assembly through the production tubing, and a bottom pressure surface acted on to move the electrical submersible pump assembly out of the well.

In other alternate embodiments, the propulsion mechanism of the self-powered robotic system can include a thrust assembly, the thrust assembly having thrust gates moveable between a gates open position and a gates closed position. The self-powered robotic system can further include an impeller operable to direct the production fluids towards the thrust gates. The thrust gates can be operable to control the speed and direction of the electrical submersible pump assembly within the inner bore of the production tubing.

BRIEF DESCRIPTION OF THE DRAWINGS

So that the manner in which the above-recited features, aspects and advantages of the embodiments of the disclosure, as well as others that will become apparent, are attained and can be understood in detail, a more particular description of the disclosure briefly summarized above may be had by reference to the embodiments thereof that are illustrated in the drawings that form a part of this specification. It is to be noted, however, that the appended drawings illustrate only preferred embodiments of the disclosure and are, therefore, not to be considered limiting of the disclosure's scope, for the disclosure may admit to other equally effective embodiments.

DETAILED DESCRIPTION OF THE EXEMPLARY EMBODIMENTS

The present disclosure will now be described more fully hereinafter with reference to the accompanying drawings which illustrate embodiments of the disclosure. Embodiments of this disclosure may, however, be embodied in many different forms and should not be construed as limited to the illustrated embodiments set forth herein. Rather, these embodiments are provided so that this disclosure will be thorough and complete, and will fully convey the scope of the disclosure to those skilled in the art. Like numbers refer to like elements throughout, and the prime notation, if used, indicates similar elements in alternative embodiments or positions.

In the following discussion, numerous specific details are set forth to provide a thorough understanding of the present disclosure. However, it will be obvious to those skilled in the art that embodiments of the present disclosure can be practiced without such specific details. Additionally, for the most part, details concerning well drilling, reservoir testing, well completion and the like have been omitted inasmuch as such details are not considered necessary to obtain a complete understanding of the present disclosure, and are considered to be within the skills of persons skilled in the relevant art.

Figure 1:
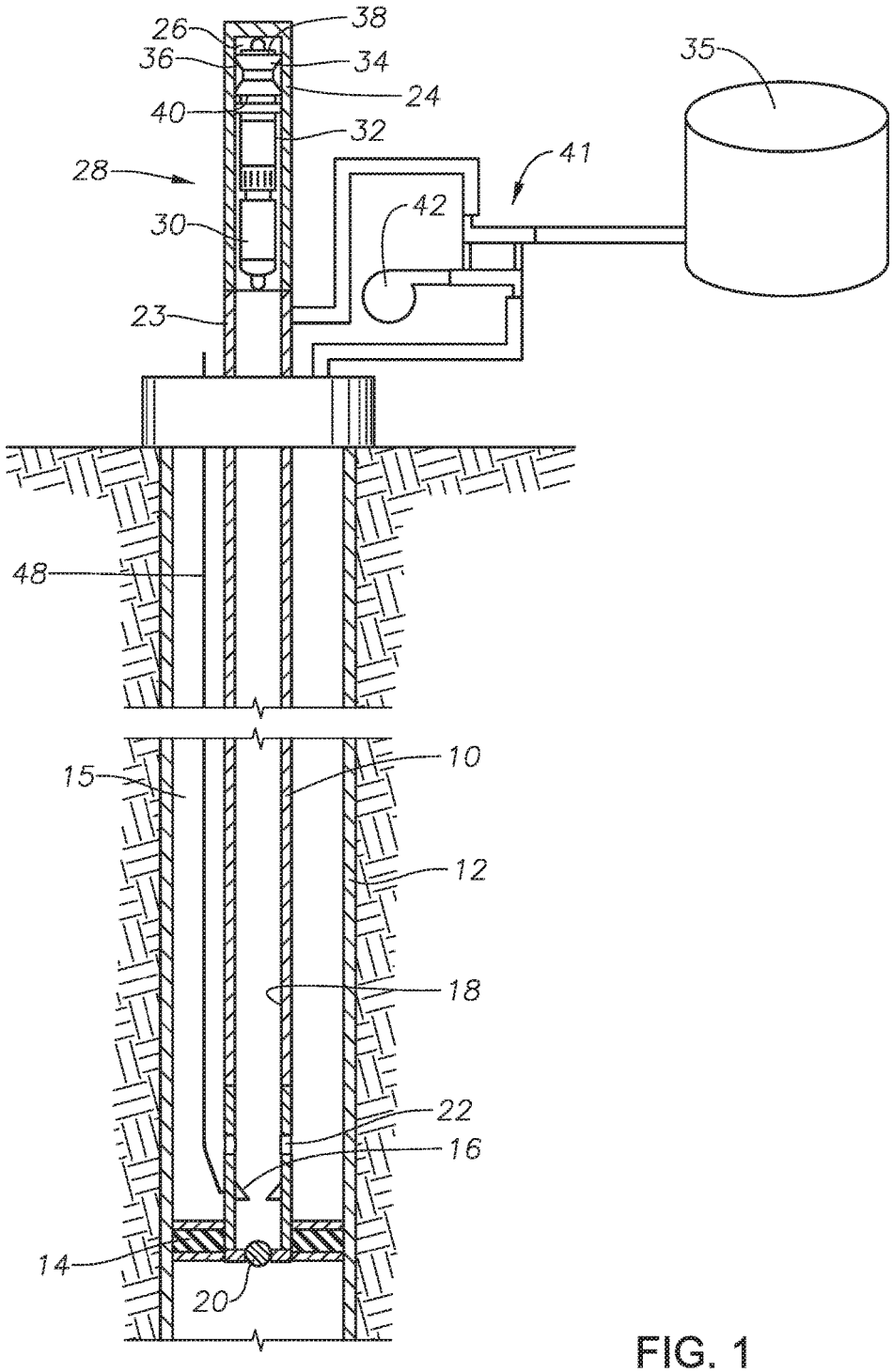
FIG. 1 is a schematic partial section view of an ESP system in accordance with an embodiment of this disclosure, shown in a launching position.

Looking at FIG. 1, production tubing 10 extends a length into subterranean well 12. Subterranean well 12 can be a cased well, with a series of casing, and in alternate embodiments, can have a section that is open or uncased. A sealing device, such as tubing packer 14 can be located in the annular space 15 outside of production tubing 10, between the inner diameter of the subterranean well 12 and the outer diameter of production tubing 10. A landing location, such as set packer 16 can be located at a predetermined distance within an inner bore 18 of production tubing 10.

Figure 2:
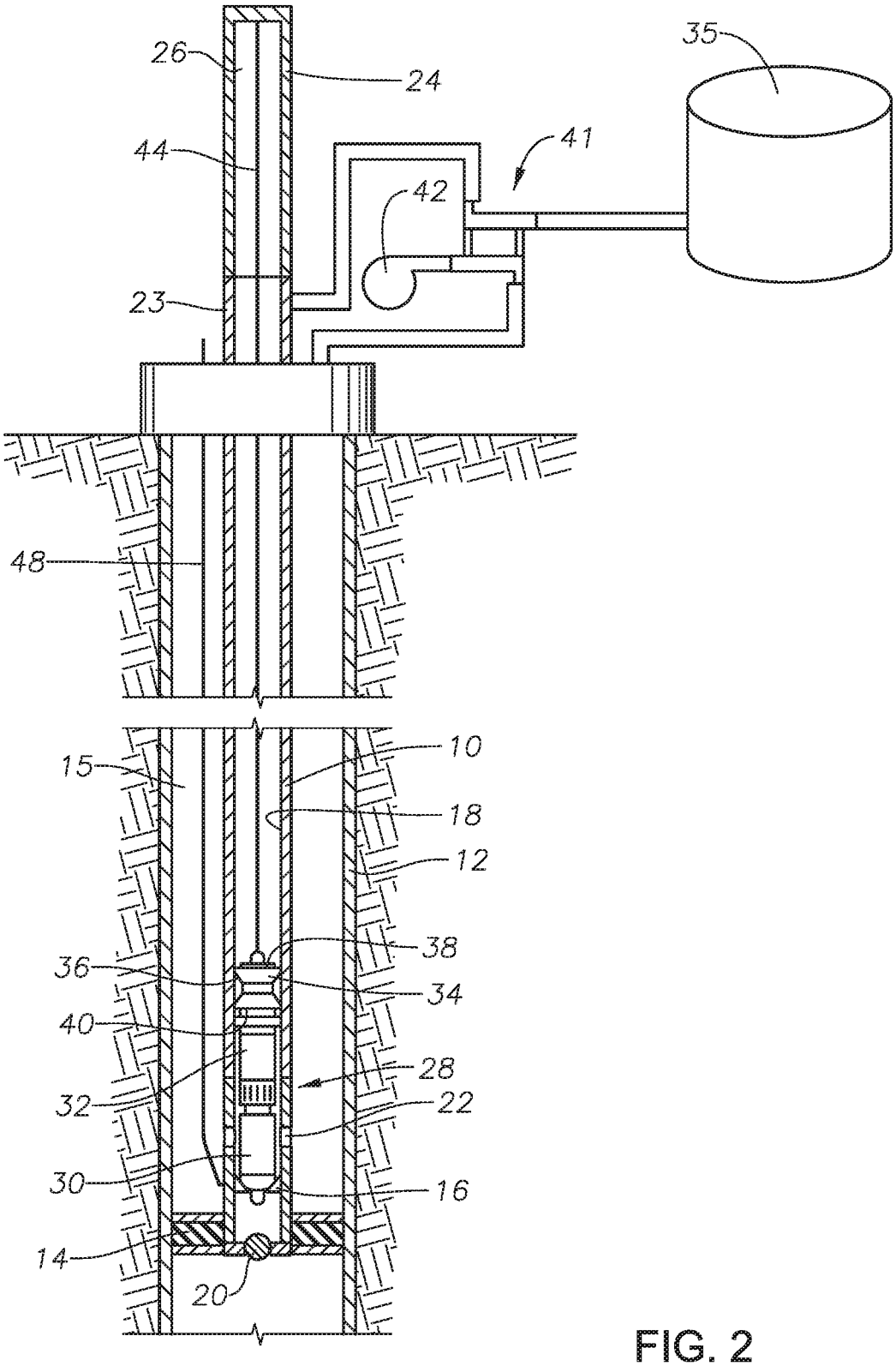
FIG. 2 is a schematic partial section view of the ESP system of FIG. 1, shown in an installed position.
Figure 3:
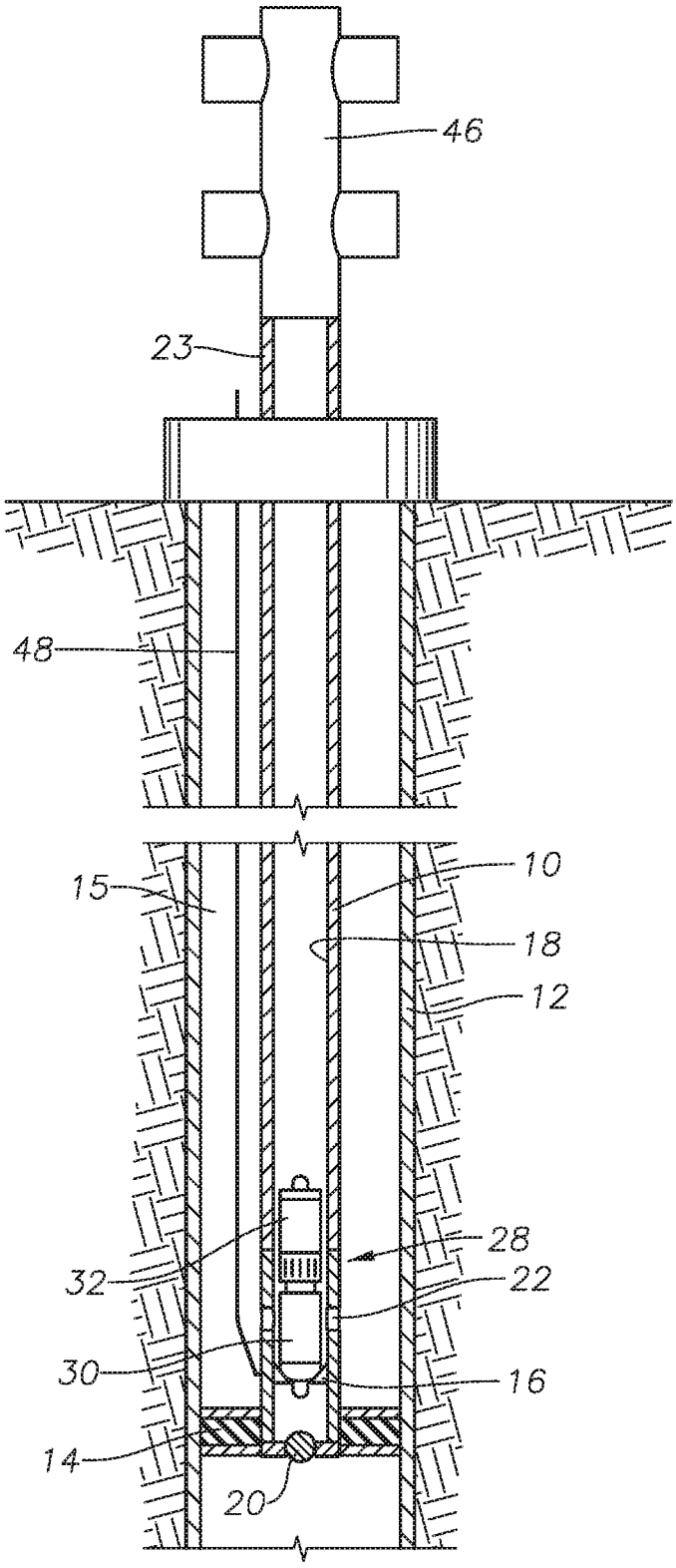
FIG. 3 is a schematic partial section view of the ESP system of FIG. 1, shown in an operating position.

Production tubing 10 can include a sealable production fluid inlet 20 and circulation fluid inlets 22. Production fluid inlet 20 provides a fluid path between a region of the well below tubing packer 14, and inner bore 18 of production tubing 10. Circulation fluid inlets 22 provide a fluid path between annular space 15 above tubing packer 14, and inner bore 18 of production tubing 10. In the examples of FIGS. 1-3, tubing packer 14 and production fluid inlet 20 are shown at a lower end of production tubing 10. In alternate embodiments, tubing packer 14 and production fluid inlet 20 can be located at an intermediate distance along production tubing 10 in order to access production fluid that are located at other depths along production tubing 10.

Still looking at FIG. 1, wellhead 23 is located at or above the earth's surface at an upper end of subterranean well 12. Pump launcher 24 can be releasably secured to wellhead 23 so that that interior cavity 26 of pump launcher 24 is in fluid communication with inner bore 18 of production tubing 10. Electrical submersible pump assembly 28 can be located within interior cavity 26. Electrical submersible pump assembly 28 can include motor 30, pump 32. Piston device 34 can be releasably attached to electrical submersible pump assembly 28.

Considering FIGS. 1-3, a propulsion system used in connection with piston device 34 will move electrical submersible pump assembly 28 through inner bore 18. The propulsion system can move electrical submersible pump assembly 28 through subterranean well 12 until electrical submersible pump assembly 28 reaches set packer 16. Electrical submersible pump assembly 28 can then be latched to set packer 16. To reverse the operation and remove electrical submersible pump assembly 28 from subterranean well 12, electrical submersible pump assembly 28 can be unlatched from set packer 16 and returned to pump launcher 24 with the propulsion system.

Looking at an example embodiment of FIGS. 1-2, piston device 34 has an outer diameter profile 36. Outer diameter profile 36 can be changed to change a vector sum of forces applied on pressure surfaces 38, 40 and outer diameter surfaces of piston device 34, to control the rate of speed of the descent or rise of electrical submersible pump assembly 28 through inner bore 18 of production tubing 10. Top pressure surface 38 is an upward facing surface that is acted on by circulation fluids that are pumped downward into inner bore 18 of production tubing 10. Bottom pressure surface 40 is a downward facing surface that is acted on by circulation fluids that are pumped upward through inner bore 18 of production tubing 10. In the example embodiment of FIGS. 1-2, the propulsion system includes valve system 41 and surface pump 42 in fluid communication with valve system 41 so that activating the propulsion system includes pressurizing a circulating fluid with surface pump 42 and moving the circulating fluid through valve system 41 so that valve system 41 directs the circulating fluid into and out of subterranean well 12 to act on pressure surfaces 38, 40 of piston device 34.

A circulation fluid source 35 can contain circulating fluid for use with surface pump 42 and valve system 41 of the propulsion system. Valve system 41 can include piping that connects circulation fluid source 35 with inner bore 18, annular space 15, and surface pump 42. A 4-way valve can control the direction of the flow of circulation fluids through valve system 41.

As an example, if outer diameter profile 36 has a smaller outer diameter than the inner diameter of inner bore 18, then the larger the pressure surfaces 38, 40, the more surface area will be subjected to the force of the circulating fluid and the faster electrical submersible pump assembly 28 can be moved through inner bore 18. However, if pressure surfaces 38, 40 are sized so that the outer diameter of piston device 34 engage the inner diameter surface of inner bore 18, the engagement of outer diameter of piston device 34 with inner bore 18, and forces resulting therefrom, will slow the rate of speed of electrical submersible pump assembly 28 through inner bore 18. The greater the interaction between the outer diameter of piston device 34 and the inner diameter surface of inner bore 18, the greater the resistance of such interaction to the circulation fluids pushing on pressure surfaces 38, 40.

Outer diameter profile 36 can be changed to be sized so that the forces generated by the interaction between the outer diameter of piston device 34 and the inner diameter surface of inner bore 18 will act as a brake and prevent electrical submersible pump assembly 28 from moving through inner bore 18. Alternately, the pressure of the circulating fluid and the direction of flow of the circulating fluid can be changed with surface pump 42 and valve system 41 to control the speed and direction of movement of electrical submersible pump assembly 28 through the subterranean well 12.

The speed of electrical submersible pump assembly 28 can be monitored with guide wire 44 (FIG. 2). Guide wire 44 is a non-load bearing cable that extends from electrical submersible pump assembly 28 to pump launcher 24. Guide wire 44 provides a means of signal communication between a surface location and piston device 34, to control piston device 34. Piston device 34 can sense a condition of subterranean well 12, such as a temperature, pressure, and depth measurements. Guide wire 44 can convey such information to a surface location.

Figure 4:
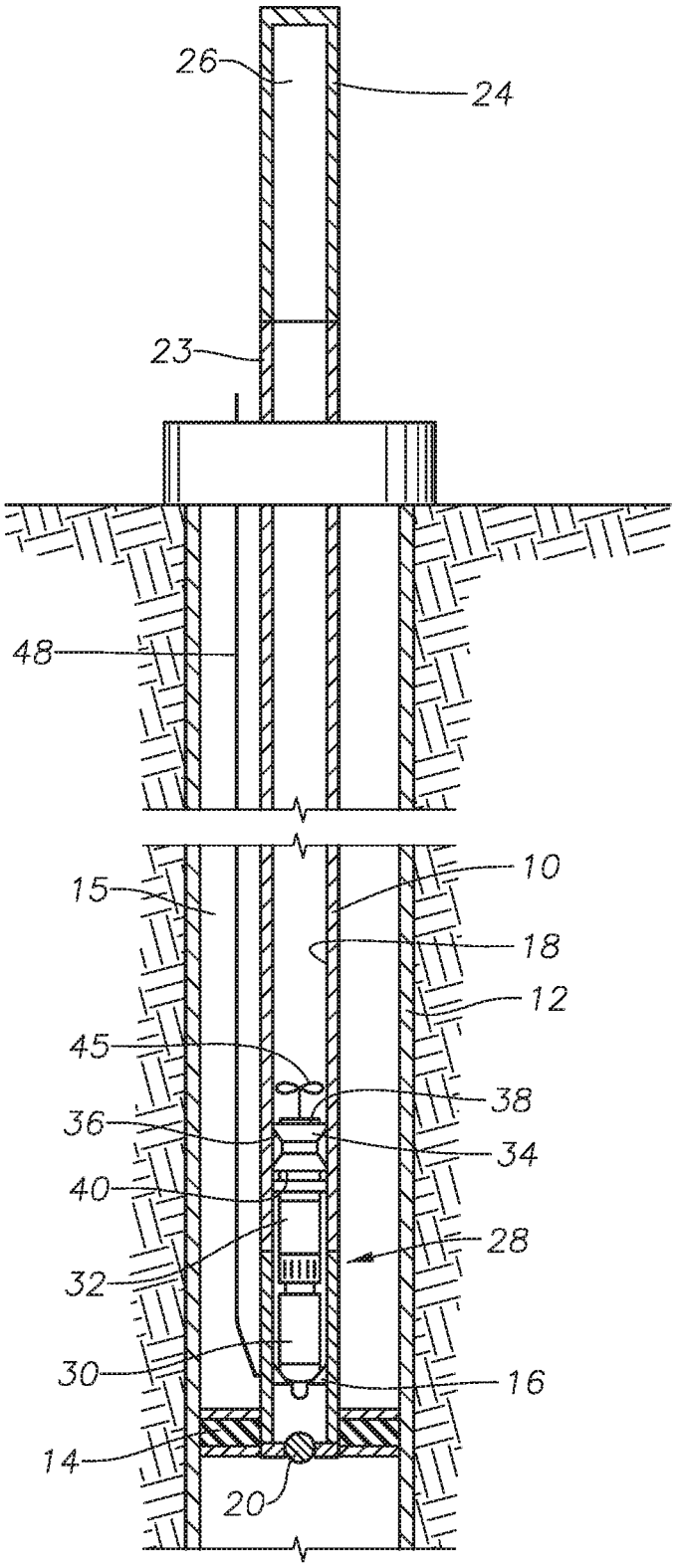
FIG. 4 is a schematic partial section view of an ESP system in accordance with an embodiment of this disclosure, shown in an installed position.

In alternate embodiments, such as shown in FIG. 4, in addition to piston device 34 or instead of piston device 34, the propulsion system of electrical submersible pump assembly 28 can include a self-powered robotic system. In such an embodiment, activating the propulsion system includes controlling the self-powered robotic system. The self-powered robotic system can be controlled remotely or can be controlled through guide wire 44. The self-powered robotic system can include a propulsion mechanism, such as a motor or turbine. The propulsion mechanism can rotate propeller 45 and the speed and direction of movement of electrical submersible pump assembly 28 through subterranean well 12 can be controlled by controlling the driver. In such an embodiment, surface pump 42 and valve system 41 may not be needed and can be excluded.

Figure 6:
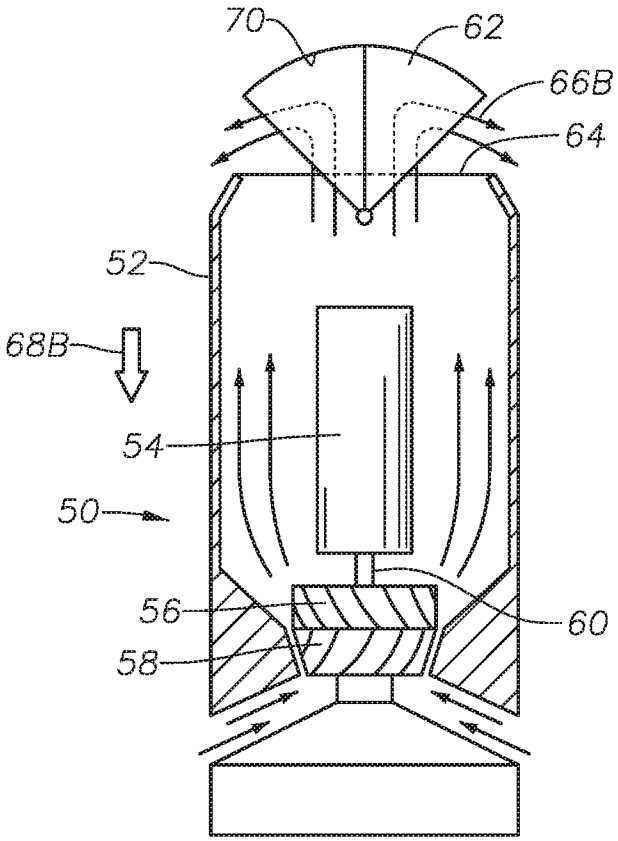
FIG. 6 is a schematic section view of the propulsion mechanism of FIG. 5, shown with the thrust gates in the gates closed position.
Figure 5:
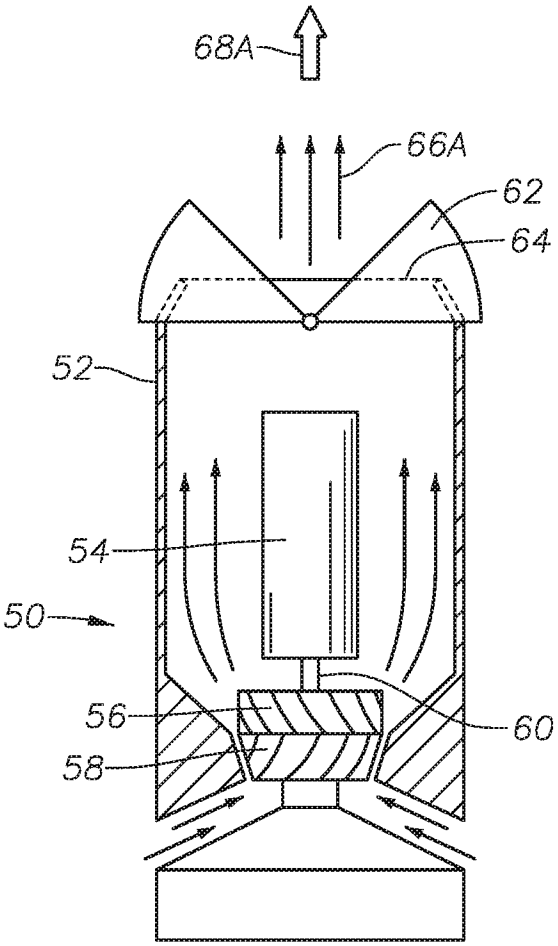
FIG. 5 is a schematic section view of a propulsion mechanism of an electrical submersible pump assembly, shown with the thrust gates in the gates open position.
Figure 7:
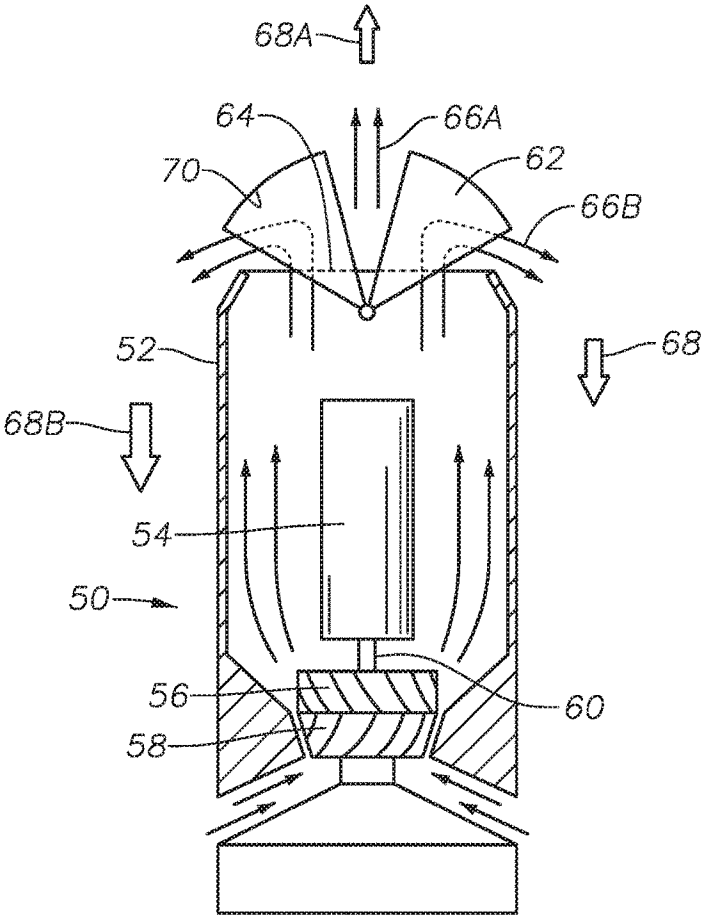
FIG. 7 is a schematic section view of the propulsion mechanism of FIG. 5, shown with the thrust gates in a position between the gates open position and the gates closed position.

Looking at FIGS. 5-7, the propulsion mechanism of the self-powered robotic system can include thrust assembly 50. Thrust assembly provides propulsion by way of thrust vector control. Thrust assembly 50 can be located at an end of electrical submersible pump assembly 28. Thrust assembly 50 can include thrust body 52 that houses thrust motor 54, diffuser 56 and impeller 58. Impeller 58 draws production fluids into thrust body 52. After passing impeller 58, diffuser 56 can transfer kinetic energy of the production fluid to pressure energy of the production fluid. Diffuser 56 can also provide a more uniform flow of production fluid through the annular space between thrust motor 54 and the internal surface of thrust body 52.

Motor shaft 60 extends between thrust motor 54 and diffuser 56 and impeller 58. Motor shaft 60 can rotate at a constant speed and direction. This allows for thrust motor 54 to operate continuously within an optimal performance range. In order to change the speed or direction of electrical submersible pump assembly 28, thrust gates 62 can be moved between gate open and gate closed positions. Impeller 58 directs production fluid through the inside of thrust body 52 towards thrust gates 62.

Looking at FIG. 5, thrust gates 62 are in the gate open position. In the gate open position, after passing through thrust body 52 production fluid can pass out of open end 64 of thrust body 52 and between thrust gates 62. Open end 64 of thrust body 52 is at an opposite end of thrust body as impeller 58. The flow of pressurized production fluid out of thrust body 52, thrust flow 66A, continues to move in the same general direction as the flow of production fluid through thrust body 52. Thrust flow 66A will cause a thrust force 68A that has a direction in the same general direction as the flow of production fluid through thrust body 52 and that results in electrical submersible pump assembly 28 moving in a direction opposite to the direction of thrust force 68A.

Looking at FIG. 6, thrust gates 62 are in the gate closed position. In the gate closed position, after passing through thrust body 52 production fluid can pass out of open end 64 of thrust body 52 and contact deflecting surfaces 70 of thrust gates 62. The flow of pressurized production fluid out of thrust body 52, thrust flow 66B, is redirected by deflecting surfaces 70 thrust gates 62 to so that the pressurized fluid is redirected to flow along an outside surface of thrust body 52. Thrust flow 66B will cause a thrust force 68B that has a direction generally opposite to the direction of the flow of production fluid through thrust body 52 and that results in electrical submersible pump assembly 28 moving in a direction opposite to the direction of thrust force 68B.

In alternate embodiments, such as shown in FIG. 7, thrust gates 62 can be in a position that is between the gate open position of FIG. 5 and the gate closed position of FIG. 6. Such an embodiment will allow a part of the production fluid to continue in the same general direction as the flow of production fluid through thrust body 52 as thrust flow 66A, and will divert another part of the production fluid to flow along an outside surface of thrust body 52 in a direction generally opposite to the direction of the flow of production fluid through thrust body 52 as thrust flow 66B. In such an embodiment, the overall magnitude and direction of thrust force 68 will be determined by the sum of thrust force 68A and 68B.

In this way, the overall magnitude and direction of thrust force 68 can be adjusted to control the speed and direction of the movement of electrical submersible pump assembly 28 within subterranean well 12.

In embodiments with thrust assembly 50, thrust assembly 50 can be secured to piston device 34. Alternately, because thrust assembly 50 can be used to control the assent and descent of electrical submersible pump assembly 28, there may be no piston device 34 and thrust assembly 50 can alternately be attached directly to pump 32 instead of piston device 34 being attached to pump 32.

Looking at FIG. 1, in an example of operation, electrical submersible pump assembly 28 can be loaded into interior cavity 26 of pump launcher 24. Pump launcher 24 is releasably secured to wellhead 23 so that interior cavity 26 is in fluid communication with inner bore 18 of production tubing 10. A propulsion system can be activated to move electrical submersible pump assembly 28 from pump launcher 24 and into subterranean well 12. Gravity can assist with moving electrical submersible pump assembly 28 through subterranean well 12 and a propulsion system will move electrical submersible pump assembly 28 through inner bore 18. Communication with piston device 34 can cause piston device 34 to control the descent of electrical submersible pump assembly 28 through subterranean well 12.

Alternately, the self-powered robotic system can be used to control the descent of electrical submersible pump assembly 28 through subterranean well 12. As described above, in such an embodiment, the self-powered robotic system can be controlled remotely or can be controlled through guide wire 44. The self-powered robotic system can include a propulsion mechanism, such as a motor or turbine.

Looking at FIG. 4, propeller 45 can be used to move electrical submersible pump assembly 28 within inner bore 18, either with or without piston device 34. The propulsion mechanism can rotate propeller 45 and the speed and direction of movement of electrical submersible pump assembly 28 through subterranean well 12 can be controlled by controlling the driver.

Looking at FIGS. 5-6, in an alternate example of operation, thrust assembly 50 can be used to move electrical submersible pump assembly 28 from pump launcher 24 and into subterranean well 12, either with or without piston device 34. Thrust gates 62 can be moved between the gates open position and the gates closed position to control the magnitude and direction of thrust force 68 for controlling the speed and direction of electrical submersible pump assembly 28 within inner bore 18.

The electrical submersible pump assembly 28 can move downward through inner bore 18 until electrical submersible pump assembly 28 lands on set packer 16. Electrical submersible pump assembly 28 can then be latched to set packer 16 to retain electrical submersible pump assembly 28 in position. Looking at FIG. 3, if piston device 34 is used, then piston device 34 can be released from electrical submersible pump assembly 28 and returned to a surface location. Alternately, the outer diameter of piston device 34 can be reduced so that production fluids can pass by piston device 34 within inner bore 18. In embodiments with a self-powered robotic system, the self-powered robotic system can be returned to a surface location or can remain downhole with electrical submersible pump assembly 28.

In embodiment that include circulation fluid inlets, circulation fluid inlets 22 can be closed to prevent fluid from above tubing packer 14 from entering production tubing 10. Production fluid inlet 20 can be opened so that a lower end of electrical submersible pump assembly 28 will be in fluid communication with production fluids that are located below tubing packer 14. Pump launcher 24 can be removed and replaced with a wellhead assembly such as tree 46 and production fluids can flow up through inner bore 18 of production tubing 10.

Electrical submersible pump assembly 28 can be activated to provide additional lift to the production fluid as it travels through production tubing 10. Production fluids will enter a lower end of electrical submersible pump assembly 28 and exit electrical submersible pump assembly 28 at a higher location before continuing up production tubing 10. A communication line or cable 48 can be used to send signals to set packer 16, circulation fluid inlets 22, and production fluid inlet 20, to perform their respective functions. Cable 48 can also be used to provide a signal and power to electrical submersible pump assembly 28.

In order to reverse the process and remove electrical submersible pump assembly 28 from production tubing 10, production fluid inlet 20 can be closed, tree 46 can be removed and pump launcher 24 can be reattached to wellhead 23. The self-powered robotic system of FIGS. 4-7 can be used to return electrical submersible pump assembly 28 to pump launcher 24. Alternately, piston device 34 can be reattached to electrical submersible pump assembly 28 and the propulsion system can move electrical submersible pump assembly 28 upwards through inner bore 18 to return to pump launcher 24.

In one example embodiment of FIGS. 1-2, the propulsion system can include valve system 41 can include a four way valve that can be actuated so that circulation fluids from fluid source 35 can be directed down inner bore 18 to push electrical submersible pump assembly 28. Circulation fluids can then exit inner bore 18 through circulation fluid inlets 22. Tubing packer 14 will prevent circulation fluids from traveling downward through annular space 15 so circulation fluids will travel up through annular space 15 and enter valve system 41. As described above, the operator can communicate with piston device 34 to change an outer diameter profile 36, to control the rate of speed of the descent or rise of electrical submersible pump assembly 28 through inner bore 18 of production tubing 10. In addition, surface pump 42 can change the speed and direction of the circulation fluids to also control the movement of electrical submersible pump assembly 28.

When removing the electrical submersible pump assembly 28 from production tubing 10, the four way valve that can be actuated so that circulation fluids from fluid source 35 can be directed down through annular space 15, through circulation fluid inlets 22 and up inner bore 18 to push electrical submersible pump assembly 28 out of inner bore 18.

Embodiments of the present disclosure, therefore, are well adapted to carry out the objects and attain the ends and advantages mentioned, as well as others inherent therein. While an embodiment of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A method for providing artificial lift to production fluids within a subterranean well, the method comprising:

loading an electrical submersible pump assembly into an interior cavity of a pump launcher, the electrical submersible pump assembly having a motor, and a pump;

releasably securing the pump launcher to a wellhead so that the interior cavity is in fluid communication with an inner bore of a production tubing that extends a length into the subterranean well;

activating a propulsion system to move the electrical submersible pump assembly from the pump launcher and into the subterranean well wherein the propulsion system includes a self-powered robotic system having a propulsion mechanism; and communicating with the propulsion system to control a descent of the electrical submersible pump assembly through the subterranean well; where the propulsion mechanism of the self-powered robotic system includes a thrust assembly, the thrust assembly having thrust gates moveable between a gates open position and a gates closed position.

2. The method according to claim 1, further comprising moving the electrical submersible pump assembly through the subterranean well with the propulsion system until the electrical submersible pump assembly reaches a set packer, then latching the electrical submersible pump assembly to the set packer.

3. The method according to claim 2, further comprising unlatching the electrical submersible pump assembly from the set packer and returning the electrical submersible pump assembly to the pump launcher with the propulsion system.

4. The method according to claim 1, wherein the propulsion system further includes a piston device, the piston device having an outer diameter profile, and where communicating with the propulsion system to control the descent of the electrical submersible pump assembly through the subterranean well includes communicating with the piston device.

5. The method according to claim 4, wherein the step of communicating with the piston device to control the descent of the electrical submersible pump assembly through the subterranean well includes changing the outer diameter profile of the piston device to change a vector sum of forces applied on the pressure surfaces of the piston device.

6. The method according to claim 4, further comprising sensing a condition of the subterranean well with the piston device.

7. The method according to claim 1, wherein activating the propulsion system includes remotely controlling the self-powered robotic system.

8. The method according to claim 7, wherein the propulsion mechanism includes a propeller and a driver to rotate the propeller, the method further comprising controlling a speed and direction of movement of the electrical submersible pump assembly through the subterranean well by remotely controlling the driver.

9. The method according to claim 1, further comprising monitoring a speed of the electrical submersible pump assembly with a guide wire, the guide wire being a non-load bearing cable that extends from the electrical submersible pump assembly to the pump launcher.

10. The method according to claim 1, where the self-powered robotic system further includes an impeller directing the production fluids towards the thrust gates.

11. The method according to claim 1, further including moving the thrust gates between the gates open position and the gates closed position to control the speed and direction of the electrical submersible pump assembly within the inner bore of the production tubing.

12. A method for providing artificial lift to production fluids within a subterranean well, the method comprising:

loading an electrical submersible pump assembly into an interior cavity of a pump launcher, the electrical submersible pump assembly having a motor, a pump, and a self-powered robotic system including a thrust assembly, the thrust assembly having thrust gates moveable between a gates open position and a gates closed position;

releasably securing the pump launcher to a wellhead so that the interior cavity is in fluid communication with an inner bore of a production tubing that extends a length into the subterranean well;

communicating with the self-powered robotic system to move the electrical submersible pump assembly from the pump launcher and into the subterranean well; and communicating with the self-powered robotic system to control a descent of the electrical submersible pump assembly through the subterranean well.

13. The method according to claim 12, further comprising moving the thrust gates between the gates open position and the gates closed position to control the speed and direction of the electrical submersible pump assembly within the inner bore of the production tubing.

14. The method according to claim 12, further comprising directing the production fluid through a body of the self-powered robotic system and towards the thrust gates with an impeller.

15. An electric submersible pump system for providing artificial lift to production fluids within a subterranean well, the system comprising:

a pump launcher releasably secured to a wellhead, the pump launcher having an interior cavity in fluid communication with an inner bore of a production tubing that extends a length into the subterranean well;

an electrical submersible pump assembly having a motor and a pump; and a propulsion system selectively moving the electrical submersible pump assembly through the production tubing, the propulsion system including a self-powered robotic system having a propulsion mechanism; where the propulsion mechanism of the self-powered robotic system includes a thrust assembly, the thrust assembly having thrust gates moveable between a gates open position and a gates closed position.

16. The system according to claim 15, where the propulsion system further includes a piston device, the piston device having an outer diameter profile, and wherein the piston device has a top pressure surface acted on to move the electrical submersible pump assembly through the production tubing and a bottom pressure surface acted on to move the electrical submersible pump assembly out of the subterranean well.

17. The system according to claim 15, where the self-powered robotic system further includes an impeller operable to direct the production fluids towards the thrust gates.

18. The system according to claim 15, wherein the thrust gates are operable to control the speed and direction of the electrical submersible pump assembly within the inner bore of the production tubing.

* * * * *